US006974316B2

(12) United States Patent
Maggio

(10) Patent No.: US 6,974,316 B2
(45) Date of Patent: Dec. 13, 2005

(54) INSTALLATION FOR PRODUCING A NONWOVEN WEB WITH VERY UNIFORM WEIGHT

(75) Inventor: Rosario Maggio, Varese (IT)

(73) Assignee: Rieter Perfojet, Montbonnot (FR)

( * ) Notice: Subject to any disclaimer, the term of this patent is extended or adjusted under 35 U.S.C. 154(b) by 0 days.

(21) Appl. No.: 10/478,561

(22) PCT Filed: May 16, 2002

(86) PCT No.: PCT/FR02/01646

§ 371 (c)(1),
(2), (4) Date: Jun. 18, 2004

(87) PCT Pub. No.: WO02/097182

PCT Pub. Date: Dec. 5, 2002

(65) Prior Publication Data

US 2004/0219242 A1 Nov. 4, 2004

(30) Foreign Application Priority Data

May 31, 2001 (FR) ..... 01 07138

(51) Int. Cl.[7] ..... D01D 5/98

(52) U.S. Cl. ..... 425/66; 425/72.2; 425/174.8 E; 425/382.2

(58) Field of Search ..... 425/66, 72.2, 174.8 R, 425/174.8 E, 382.2; 156/433, 441, 167, 181

(56) References Cited

U.S. PATENT DOCUMENTS

| | | | | |
|---|---|---|---|---|
| 3,766,606 | A | 10/1973 | Piper et al. | 28/283 |
| 4,820,142 | A | 4/1989 | Balk | 348/97 |
| 4,961,695 | A * | 10/1990 | Hirschmann et al. | 425/72.2 |
| 5,211,903 | A | 5/1993 | Reifenhauser | 264/555 |
| 5,460,500 | A * | 10/1995 | Geus et al. | 425/66 |

FOREIGN PATENT DOCUMENTS

| | | |
|---|---|---|
| DE | 1635596 | 3/1971 |
| FR | 2792656 | 10/2000 |

* cited by examiner

*Primary Examiner*—Joseph S. Del Sole
(74) *Attorney, Agent, or Firm*—Pearne & Gordon LLP

(57) ABSTRACT

The invention concerns an installation for producing a nonwoven web wherein the distance between the lower edge of the slit drawing device and the upper edge of the diffuser is maintained constant by uniformly distributed hasps.

3 Claims, 4 Drawing Sheets

INSTALLATION FOR PRODUCING A NONWOVEN WEB WITH VERY UNIFORM WEIGHT

BACKGROUND OF THE INVENTION AND RELATED ART

The present invention relates to installations for producing nonwoven webs.

An installation for producing a nonwoven web is already known that comprises, in succession from the top down, a generator of a curtain of filaments, especially plastic filaments, a slot attenuator for attenuating the filaments of the curtain followed, at a distance from the lower edge of the attenuating slot attenuator, by a diffuser and a conveyor for collecting the filaments exiting the diffuser.

The generator of a curtain of filaments usually comprises an extruder intended to extrude a molten organic polymer through a spinneret drilled with numerous holes so as to form a curtain of filaments and, beneath the spinneret, a device for cooling the curtain of filaments. The slot attenuator for attenuating the filaments of the curtain generally has opposed sidewalls and opposed endwalls that define an oblong inlet slot for receiving the filaments and an oblong outlet slot from which the filaments exit. A slot-shaped passage extends between the inlet and the outlet and the filaments pass through it, being attenuated by the injection of a stream of air into the slot-shaped passage, which stream is sufficient to attenuate the filaments. Beneath this slot attenuator for attenuating the filaments of the curtain is the diffuser, which is intended to spread out the incoming curtain. Since the diffuser diverges or is flared downward, the curtain that passes through it progressively spreads out as it falls. The web that thus forms on the collecting conveyor placed beneath the diffuser should be more uniform.

It turns out in practice that this uniformity as defined for example by the weight per $m^2$ of the web is not achieved as well as would be liked.

SUMMARY OF THE INVENTION

The invention remedies this drawback by an installation of the type above in which the web formed is more uniform.

According to the invention, the distance between the lower edge of the attenuating slot attenuator and the upper edge of the diffuser is constant to within ±7%, and preferably to within ±5%.

It was realized in fact, unpredictably, that it is of primary importance as regards the uniformity of the web for the distance between the lower edge of the attenuating slot attenuator and the upper edge of the diffuser to be approximately constant.

However, this had not been achieved hitherto since the oblong slot edges in question usually have their long side with lengths exceeding 150 cm, which sag or deform under the effect of the actual weight of the attenuator and of the diffuser.

According to the invention, means are therefore provided for keeping the lower edge of the attenuating slot attenuator, and also preferably the upper edge of the diffuser, horizontal. The means are such that they leave the gap between the lower edge of the attenuating slot attenuator and the upper edge of the diffuser clear, but they prevent these edges from sagging or curving inward. These means may be formed by the fact that the attenuator and the diffuser are, at least along the edges in question, made of a very rigid material.

According to one particularly preferred embodiment, the means comprise bridges uniformly distributed along the perimeter of the lower edge and of the upper edge, the branches of which bridge are fixed to the attenuator at points closer to its lower edge than its upper edge and to the diffuser at points closer to its upper edge than its lower edge. These bridges or other means for keeping the edges horizontal, which may be provided every 200 to 300 mm, ensure horizontality of the edges and therefore constancy of their mutual separation, without, however, requiring the use of very rigid and therefore expensive materials.

The uniformity of the web is also improved if at least one slot extending over the entire perimeter of the diffuser and means for keeping the lower and upper edges of this slot horizontal are provided along the diffuser, it being possible for these means again to be bridges such as those used to keep the gap between the attenuating slot attenuator and the diffuser constant.

The distance between the upper edge of the diffuser and the lower edge of the attenuator is generally between 3 mm and 5 mm.

DETAILED DESCRIPTION OF THE DRAWINGS

Figure 1:
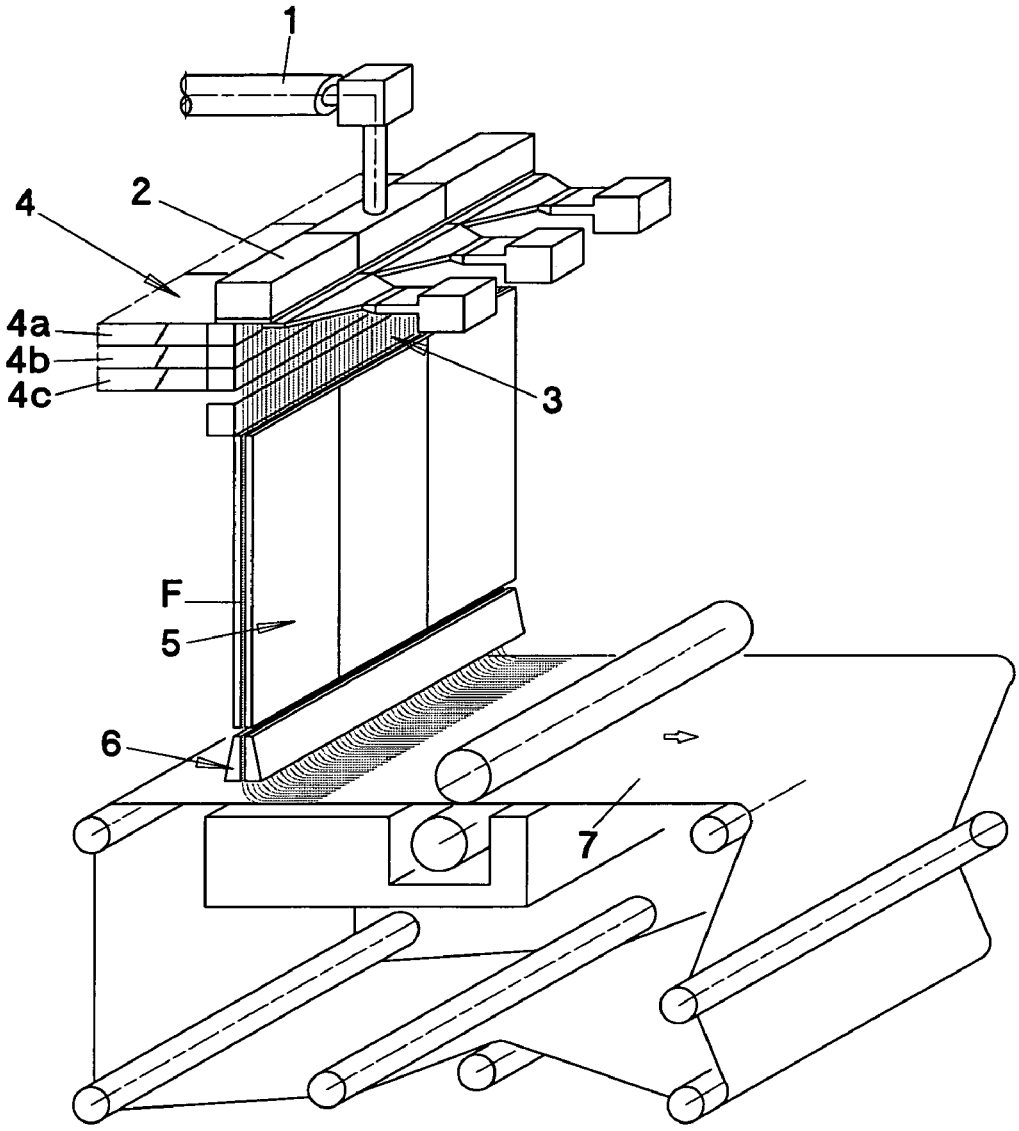
FIG. 1 is a perspective schematic view of an installation according to the invention.

The installation comprises an extruder 1 fed with a synthetic polymer and a spinneret 2 for forming a curtain of filaments 3. The spinneret is formed from a plate having numerous holes with a diameter that depends on the filaments extruded. These holes are distributed over a number of parallel rows. For example, there are 18 rows over a spinneret width of 140 mm.

At the exit, that is to say just below the spinneret 2, there is a cooling unit 4 for lowering the temperature of the filaments and composed of a number of successive zones 4*a*, 4*b*, 4*c*, which allows the curtain of filaments 3 to be subjected to streams of air whose velocity and temperature may be adjusted. The length of this cooling zone may be around 1200 mm.

Downstream, and therefore beneath this cooling unit 4, there is a conventional attenuator 5 with a slot F. It is composed of two walls that define between them a passage in the form of a slot F, into which pressurized air, for example at a pressure of 0.5 bar, is injected. This slot attenuator makes it possible to suck the curtain of filaments and entrain it by high-velocity air streams, thereby attenuating the filaments.

Figure 2:
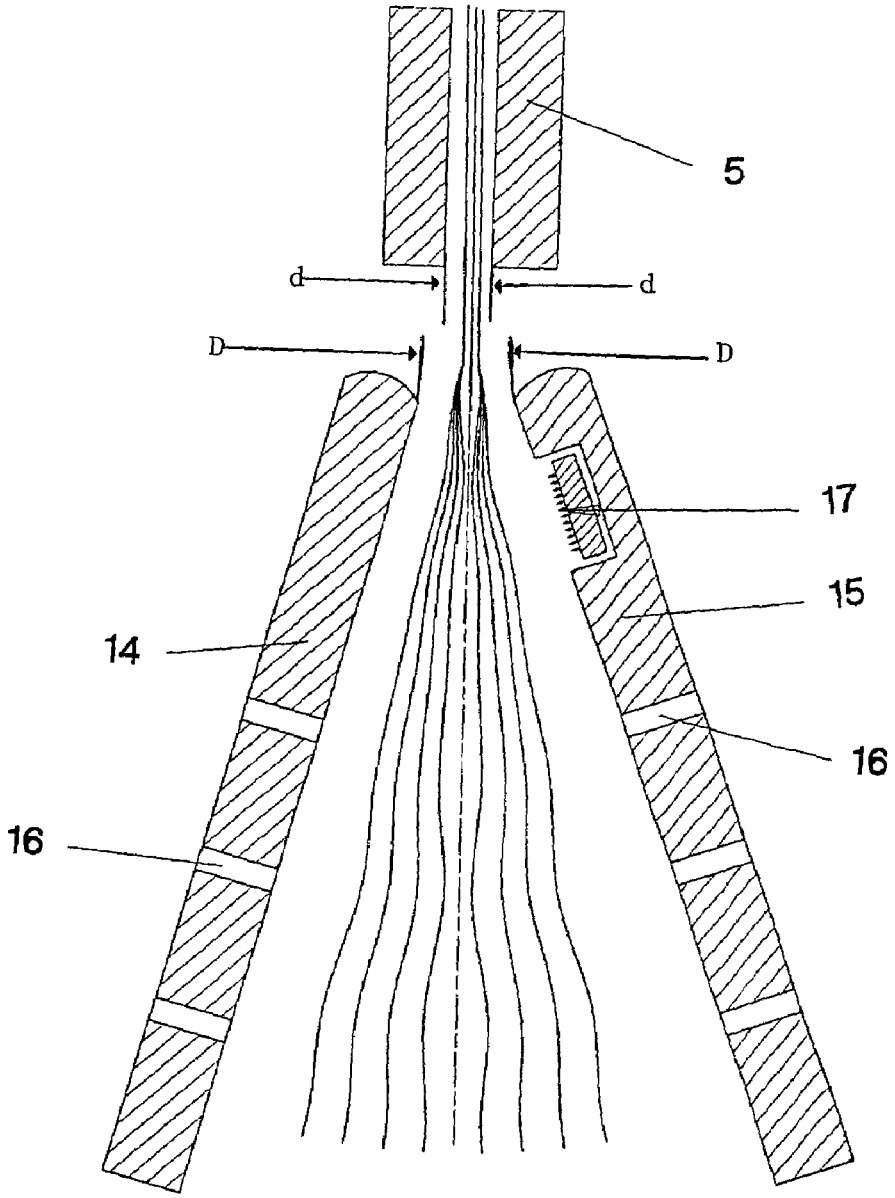
FIG. 2 is a sectional view of the diffuser.
Figure 3:
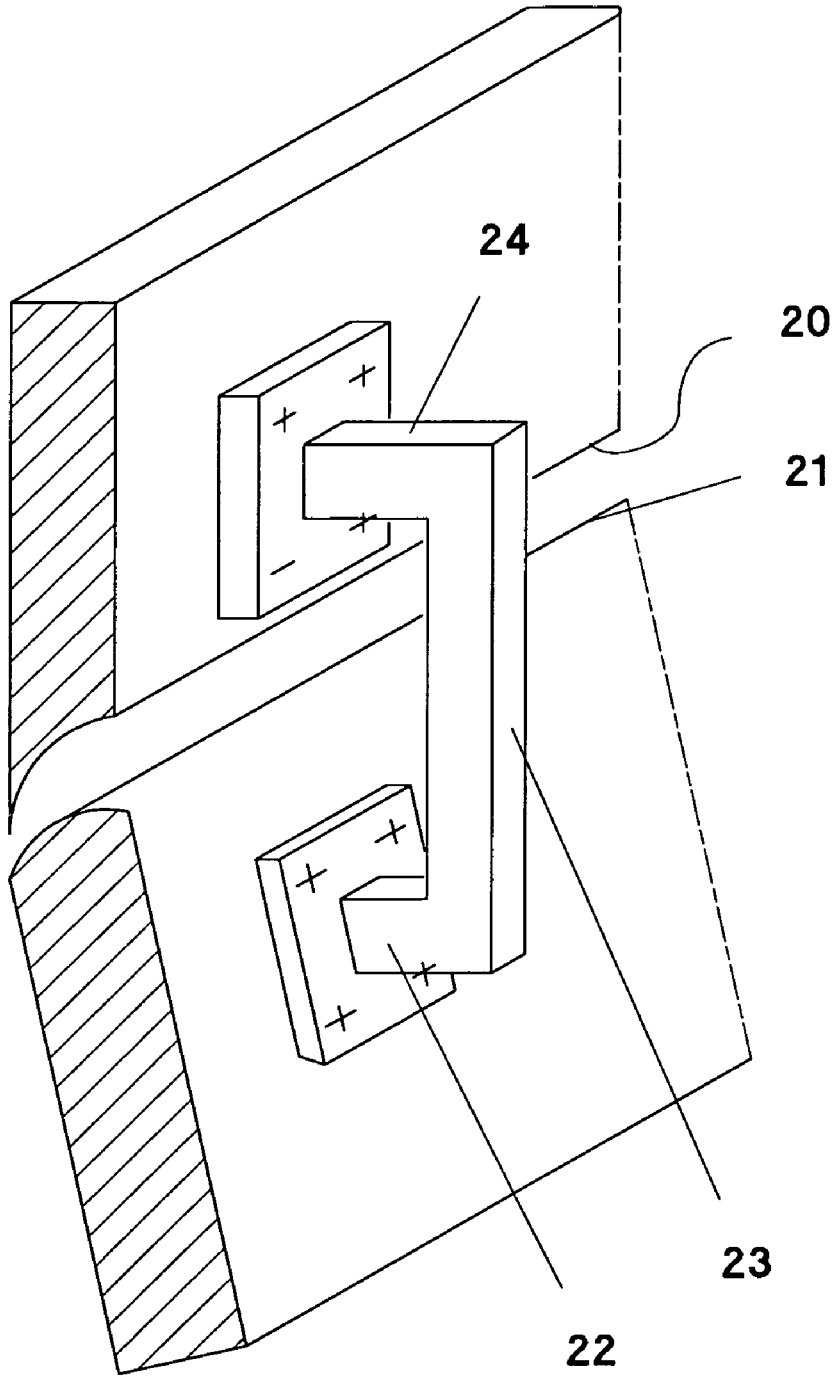
FIG. 3 is a perspective partial view showing a bridge fixed to the attenuating slot attenuator and to the diffuser.

Mounted below the slot attenuator 5 is a diffuser 6. This diffuser 6, shown in particular in FIG. 2, has two walls 14, 15 making an angle of 5° between them and each being provided with three openings 16 extending over the entire length. The diffuser 6 is placed 3 mm below the attenuator 5 and the width d of the attenuation slot is just less than the width D of the top of the passage defined by the diffuser 6. Mounted in the wall 15 of the diffuser 6 is the electrostatic device 17.

There is a conventional conveyor 7 beneath the diffuser 6.

The distance between the lower edge 20 of the attenuating slot attenuator and the upper edge 21 of the diffuser is constant to within 5%, being 3 mm∓0.15 mm. Screwed into the top of the diffuser is the lower branch 22 of a bridge 23, the upper branch 24 of which is screwed into the bottom of the attenuating slot attenuator. The central part of the bridge 23 is at a distance of at least 1 cm from the gap between the lower edge 20 and the upper edge 21 so that this gap remains entirely clear.

Figure 4:
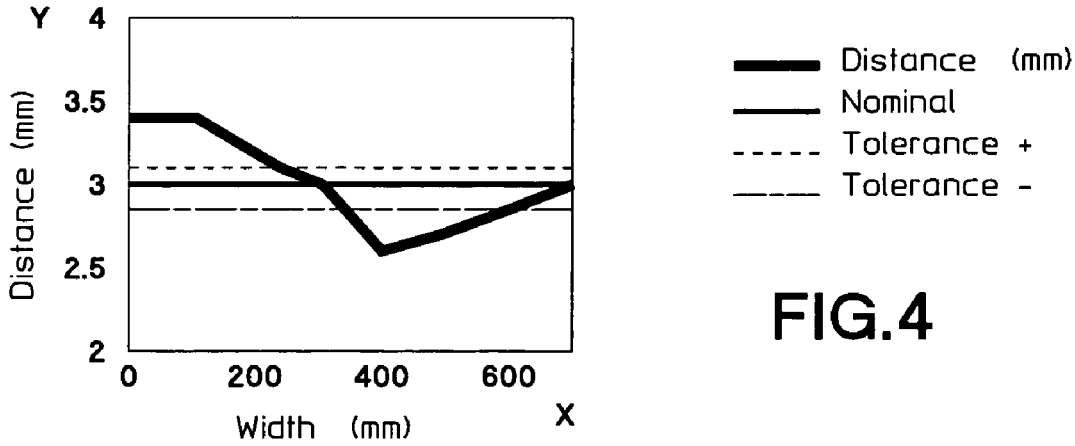
FIGS. 4 and 5 are graphs illustrating the invention.
Figure 5:
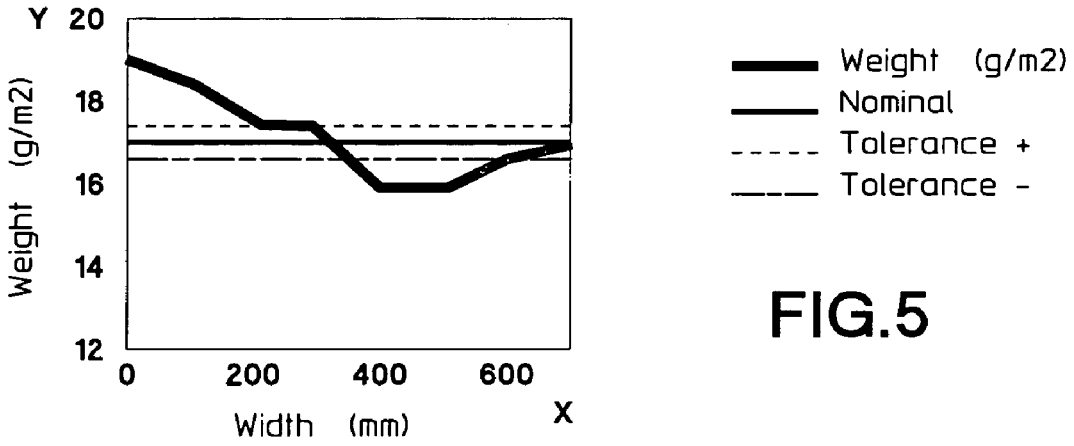

FIG. 4 is a graph showing the variation in the distance between the edge 20 and the edge 21, while FIG. 5 corresponds to the variation in the weight in $g/m^2$ of the web deposited on the conveyor as a function of these distances.

In FIG. 4, the y-axis shows the distances in mm between the lower edge of the attenuator and the upper edge of the diffuser and the x-axis shows the widths of the web in mm along these edges, while in FIG. 5 the widths of the web in mm are plotted on the x-axis and the weight in $g/m^2$ of the web is plotted on the y-axis. These show that, for the width x=200, a still acceptable weight in $g/m^2$ is obtained, but the slope of the weight in $g/m^2$ curve changes suddenly with the sudden increase in weight below x=200 mm, whereas the slope of the curve representing the distance between the two edges is constant between approximately 100 mm and 300 mm.

What is claimed is:

1. An installation for producing a nonwoven web comprising, in succession from the top down, a generator of a curtain of filaments, a cooling unit for cooling the curtain, a slot attenuator for attenuating the filaments of the curtain, said slot attenuator having a lower edge followed, at a distance from the lower edge of the attenuating slot attenuator, by a diffuser with an upper edge and a conveyor, wherein a gap between the lower edge of the slot attenuator and the upper edge of the diffuser is unobstructed and the distance between the lower edge of the attenuating slot attenuator and the upper edge of the diffuser is constant to within +5%, and further including means for keeping the edges horizontal and spaced apart, said means being laterally spaced from the edges and extending between the attenuating slot attenuator and the diffuser at spaced locations along the edges.

2. The installation as claimed in claim 1, characterized in that the means comprise bridges uniformly distributed along the perimeter of the lower edge and of the upper edge, the branches of which bridges are fixed to the attenuator at points closer to its lower edge than its upper edge and to the diffuser at points closer to its upper edge than its lower edge and the central part of the bridges are laterally at a distance of at least 1 cm from the gap.

3. The installation as claimed in claim 1, characterized in that means for keeping the edges horizontal are provided every 200 to 300 mm along the edges.

* * * * *

UNITED STATES PATENT AND TRADEMARK OFFICE

CERTIFICATE OF CORRECTION

PATENT NO. : 6,974,316 B2
APPLICATION NO. : 10/478561
DATED : December 13, 2005
INVENTOR(S) : Rosario Maggio It is certified that error appears in the above-identified patent and that said Letters Patent is hereby corrected as shown below:

Column 4, line 9 (Claim 1, line 12), delete "+5%" and insert -- ±5% --.

Signed and Sealed this

First Day of August, 2006

JON W. DUDAS
*Director of the United States Patent and Trademark Office*